US008740578B2

(12) United States Patent
Kamecke et al.

(10) Patent No.: US 8,740,578 B2
(45) Date of Patent: Jun. 3, 2014

(54) VACUUM PUMP IN PARTICULAR ROOTS TYPE PUMP

(75) Inventors: Hannes Kamecke, Frechen (DE); Wolfgang Giebmanns, Erftstadt (DE); Dirk Schiller, Huerth (DE)

(73) Assignee: OERLIKON LEYBOLD VACUUM GmbH, Cologne (DE)

( * ) Notice: Subject to any disclaimer, the term of this patent is extended or adjusted under 35 U.S.C. 154(b) by 432 days.

(21) Appl. No.: 13/055,224

(22) PCT Filed: Jun. 10, 2009

(86) PCT No.: PCT/EP2009/057192

§ 371 (c)(1),
(2), (4) Date: Jan. 21, 2011

(87) PCT Pub. No.: WO2010/009939

PCT Pub. Date: Jan. 28, 2010

(65) Prior Publication Data

US 2011/0129374 A1 Jun. 2, 2011

(30) Foreign Application Priority Data

Jul. 22, 2008 (DE) ..... 10 2008 034 073
Sep. 18, 2008 (DE) ..... 10 2008 047 712

(51) Int. Cl.
*F04B 49/24* (2006.01)

(52) U.S. Cl.
USPC ..... 417/310

(58) Field of Classification Search
USPC ..... 417/310
See application file for complete search history.

(56) References Cited

U.S. PATENT DOCUMENTS

| | | | | | |
|---|---|---|---|---|---|
| 2,268,806 | A | * | 1/1942 | Curtis | 137/527 |
| 2,925,786 | A | * | 2/1960 | Hill | 418/152 |
| 3,146,720 | A | * | 9/1964 | Henry | 417/310 |
| 3,395,727 | A | * | 8/1968 | Weise et al. | 137/527.4 |
| 4,019,532 | A | * | 4/1977 | Schittek | 137/527 |
| 4,188,973 | A | * | 2/1980 | Weise et al. | 137/514 |
| 4,470,767 | A | * | 9/1984 | Frings et al. | 417/310 |
| 4,556,083 | A | | 12/1985 | Schleiter, Sr. | |

FOREIGN PATENT DOCUMENTS

| | | | |
|---|---|---|---|
| DE | 2844019 | A1 | 4/1980 |
| DE | 9413445.6 | U1 | 10/1994 |
| FR | 430357 | A | 10/1911 |
| GB | 190911193 | A | 5/1910 |

* cited by examiner

*Primary Examiner* — Charles Freay
(74) *Attorney, Agent, or Firm* — Fay Sharpe LLP

(57) ABSTRACT

A vacuum pump, in particular a pump of the type with rolling bodies, includes rotary bodies (12) arranged in a suction chamber (10). The pressure side (30) of the pump is connected to the suction side (20) by a connecting channel (22). In the connecting channel (22), a valve (24) is arranged which closes a through opening (32). On exceeding a set pressure difference between the pressure side (30) and the suction side (20), the valve opens automatically. In order to reduce the necessary space and to reduce the switching noise from the valve, the valve body is embodied as a valve flap (28).

19 Claims, 3 Drawing Sheets

VACUUM PUMP IN PARTICULAR ROOTS TYPE PUMP

BACKGROUND

The invention relates to a vacuum pump, in particular a pump of the rotary-piston or Roots type.

Vacuum pumps comprise pump elements which are arranged in a suction chamber and, in case of rotary-piston pumps, are provided in the form of two rotary pistons. By rotation of the rotary pistons, the medium which is to be pumped will be conveyed from a suction side of a suction chamber to a pressure side. The conveying capacity of rotary-piston pumps is limited particularly by a maximal pressure difference between the suction side and the pressure side. In rotary-piston pumps having a pumping chamber with a large volume, this maximal pressure difference will be about 50 mbar, and in smaller rotary-piston pumps, it will be about 80 mbar. Should the maximal pressure difference be exceeded, this may happen to cause a thermal overstressing of the rotary-piston pump, particularly of the drive motor. To avoid the occurrence of such overstressing, some rotary-piston pumps comprise a connection channel connecting the pressure side to the suction side, allowing the conveyed medium to flow back from the pressure side to the suction side. Arranged in said connection channel is a valve, the so-called bypass line valve. At the point when a predetermined pressure difference has been reached, this usually weight- and/or spring-loaded valve will open.

Such a valve arranged in the connection channel of a rotary-piston pump is known e.g. from U.S. Pat. No. 4,470,767. Said valve is a disk valve comprising a disk-shaped valve body for closing a passage opening in the connection channel.

In modern production processes such as, e.g., vacuum coating processes, very short process times have to be achieved. For instance, it is required to realize cycle times of less than a minute. As a consequence, the vacuum pumps used in such processes, which particularly will be rotary-piston pumps, are required to perform the whole operating cycle of the pump within merely a few seconds. This has the consequence that the bypass line valve will be opened very quickly or abruptly. Due to the impacting of the valve disk or of components connected to the valves, increased operating noises will be generated. Further, such impacts may cause damage to the pump housing. In an effort to avoid such damage and to reduce operating noises, special valves have been developed wherein the valve disk is not only spring-loaded but additionally is provided with a hydraulic damper. Thereby, the quick or abrupt movement of the valve disk will be dampened.

Disk valves with or without hydraulic or mechanical damping have the dis-advantage that large masses must be moved. Consequently, disk valves are sluggish in operation. Particularly in rotary-piston valves having a large volume, it is required to provide correspondingly large valve disks for allowing a sufficient quantity of medium to flow back through the connection channel within a short time. A further disadvantage includes the large space requirement of the disk valve. This leads to bulky sizes of the pump houses and thus to increased costs. A further disadvantage of spring- and weight-loaded disk valves is the need, because of the gravitational acceleration, to give consideration to the mounting position. A special orientation of the disk valve at an angle of 45° relative to the conveying direction of the rotary-piston pump is known from U.S. Pat. No. 4,470,767. Thereby, it is possible to install the rotary-piston pump in least in two different mounting positions in which the disk valve is always arranged at an angle of 45° relative to the gravitational acceleration.

It is an object of the invention to provide a vacuum pump, in particular a pump of the type with rotary-pistons, by which shorter process times can be accomplished in modern production processes.

Also the vacuum pump of the invention, which particularly is a pump of the type with rotary-pistons, comprises a valve arranged in the connection channel between the pressure side and the suction side. Said valve comprises a spring-loaded valve body closing a passage opening of the connection channel, wherein, when a maximal pressure difference between the pressure side and the suction side is exceeded, the valve will be opened, in particular automatically. According to the invention, said valve body is formed as a pivotable valve flap. This has the particular advantage that the mass which has to be moved can be considerably reduced. It is thus made possible to not only realize a faster opening process but also, particularly, to achieve a considerable reduction of the noise development during the opening of the valve. Possible damage to the pump housing as might be caused when opening the valve, is thus avoided. By the provision of a flap valve instead of a disk valve, the invention makes it possible to realize shorter process times. A further considerable advantage of the invention resides in the potential for a distinct reduction of the constructional space, which is accomplished because the provision of a valve flap obviates the need for a cylindrical housing projection for arranging the disk valve therein. Instead, it is now possible to arrange the flap valve e.g. in a corner region of the housing so that the outer dimensions of the pump housing can be distinctly reduced.

Further, the geometric shape of the valve flap can be selected freely as desired. No need exists for a round passage opening arranged in the connection channel and closed by a round valve plate. Instead, according to a particularly preferred embodiment of the invention, the passage opening in the connection channel has a substantially rectangular and/or longitudinal shape. Particularly, the passage opening can extend substantially along the whole width of the connection channel. Preferably, herein, the connection channel is guided along the housing of the pumping chamber and extends substantially across the whole width of the pump housing and respectively the pumping chamber. In dependence on the pumping volume of the rotary-piston pump, the minimum cross section of the connection channel has to be defined to the effect that, upon occurrence of a load, a sufficient quantity of conveyed medium can be returned via the connection channel to the suction side. By the provision of a preferably rectangular valve flap, substantially the whole cross section of the connection channel can be opened when the maximum pressure difference is exceeded. This is not possible if disk valves are provided.

Since the process of opening the flap valve involves a pivoting of the valve flap about the rotary axis but not—in contrast to disk valves—a displacement of the whole valve disk, the masses which have to be moved are considerably smaller. Separate hydraulic or pneumatic damping is not required, even though it can be provided in special applications. Further, the valve body, when opened, will assume an orientation parallel to the flow direction so that an abutting impact will be avoided.

Since the mass of the moved components in a flap valve is small and is distributed such that, as provided by a particularly preferred embodiment of the invention, the gravitational center of the valve flap is located in the region of the pivot axis, the response behavior of the flap valve is independent of the mounting position of the rotary-piston pump. For the design of the system, this is of considerable advantage because the mounting positions of the rotary-piston pump are not restricted to only two positions as described in U.S. Pat. No. 4,470,767. Instead, the invention offers the special advantage that the position and the orientation of the valve within the pump are freely selectable. This allows for a reduction of the constructional space.

The pivot axis of the valve flap is preferably arranged on a side facing away from the pumping chamber. Preferably, the pivot axis of the valve flap extends parallel to rotary axes of the pump elements which in a rotary-piston pump are formed as rotary pistons. Thus, it is made possible that the pivot axis extends across the whole width of the pump housing. Particularly by the arrangement of the pivot axis on the side of the connection channel facing away from the pumping chamber, the pivot axis can now be arranged in a corner or an edge region of the pump housing. In this manner, the constructional space required for the flap valve can be considerably reduced, thus allowing for distinctly smaller outer dimensions of the pump housing than would be the case if corresponding disk valves were provided.

The pivot axis does not necessarily have to be a physical shaft or axis. Instead, it can also be a virtual axis. For instance, the pivot axis can also be realized in the form of a living hinge or the like. Further, it is possible to produce the valve flap from an elastic material at least in the region of the pivot axis so that, when the valve flap is being opened, the flap will be elastically deformed or bent in this region.

Further, the valve body can have a two-part design, the two parts preferably being configured in the manner of a swing door and preferably comprising respectively one pivot axis, with said pivot axes being arranged opposite to each other.

Further, it can be provided that said one or two pivot axes are arranged within the flow channel so that a fully opened valve flap will be arranged within the connection channel and be oriented in the flow direction. Thereby, depending on the given case, the constructional space may be still further reduced.

SUMMARY

Further, flap valves have a smaller flow resistance, with the resultant possibility to achieve smaller cross sections and, consequently, a smaller constructional space.

According to the invention, the valve flap is spring-loaded. Thus, the spring connected to the valve flap is connected indirectly or directly to the valve flap itself, or to a pivot arm connected to the valve flap. Preferably, the spring used herein is a torsion spring which particularly surrounds the pivot axis of the valve flap. Thereby, the constructional space required for the flap valve can be further reduced.

Depending on the respective constructional design of the pump and particularly of the pump housing, it can be of advantage to connect the valve flap to a pivot arm. This pivot arm in turn is connected to the pivot axis. In such an embodiment, a torsion spring can be provided. However, it is also possible and—depending on the design of the pump housing—suitable to provide a tension spring or pressure spring which is connected to the pivot arm.

Preferably, use is made of springs whose characteristic line is substantially constant over the whole angle of the valve flap. Further, a setting element can be provided by which the spring force can be set. By setting the spring force, one can set the pressure difference at which the valve will open. Further, an adjustment and respectively fine adjustment of the spring force can be performed. Further still, by the provision of a setting element, changes of the spring properties can be compensated for. The setting element can be e.g. a rotatable setting knob connected to one end of the torsion spring and operable to twist the torsion spring. Such a setting element comprises e.g. locking elements and is rotatable about the central axis of the torsion spring. In case that tension or pressure springs are used, the spring force is settable because of the possibility to change the position of the mounting support of one end of the tension or pressure spring.

According to a particularly preferred embodiment of the invention, the valve body is not round but has a width, extending parallel to the pump housing, which is larger than the height of the valve body. It is especially preferred to provide a valve body having an oval, elliptic or, in particular, rectangular cross section. It is therefore possible, particularly, that the valve body extends parallel to the rotary axis of the pump element. Thus, even though the constructional space may be small, a large flow cross section can be realized. This is of advantage in comparison to an arrangement comprising several disk valves adjacent to each other, since there is no need for mechanical connections of the individual disk valves, separate bearings etc. Thus, the valve body, which according to a particularly preferred embodiment of the invention is provided just once, extends in the longitudinal direction parallel to the pump housing. Preferably, the valve body extends substantially along the whole width of the housing, parallel to the rotary axis of the pump element.

According to an alternative embodiment—to be regarded as an invention in its own right—of the valve provided in the vacuum pump which particularly is a rotary-piston pump, there is performed not a pivoting movement of the valve body but a shifting movement of the valve body. According to this invention, the valve body has no round cross section. Instead, the valve body particularly has a rectangular, oval or elliptic shape. According to the invention, the valve body has a width which is larger than its height, with the valve body extending parallel to the pump housing. Particularly, the width of the valve body extends in the direction of the width of the connection channel. Even though such a valve body does not have all of the above described advantages of a valve flap, it does result in a distinctly improved valve when compared to a disk valve. Due to the non-round configuration of the valve body, a considerably larger passage opening can be realized which, according to a particularly preferred embodiment, extends substantially across the whole width of the connection channel. Thus, when the valve is opened, it will clear substantially the whole cross section of the connection channel. Because of the larger passage opening which can be realized here, it is already in the not yet fully opened state of the valve that a distinctly larger mass flow will stream through the passage opening than would be the case in a disk valve. In such a valve body, particularly a rectangular one, it is possible, without enlargement of the pump housing, to realize a considerably larger passage opening because the latter can extend substantially across the whole width of the connection channel. Thus, also in this embodiment, the noise development can be significantly reduced as compared to disk valves.

In order to keep the valve closed until a maximal pressure difference is exceeded, the valve body is spring-loaded wherein, according to a particularly preferred embodiment, tension springs are provided. These have the advantage that a kinking of the springs is avoided. To keep as low as possible the flow resistance that occurs in disk valve flaps, it is preferred that said spring elements are arranged in the lateral edge region of the valve flap.

Preferably, the valve flap or the pump housing is provided with guide elements for safeguarding a defined movement of the valve flap when the flap is being opened. Said guide elements are preferably arranged parallel to each other and in the moving direction of the valve body so that, during the opening process, the movement of the valve body will be a purely translatory movement.

Further, it is possible to provide curved guide elements such as, e.g., guide tracks or the like. Thereby, while the valve flap is being opened in a manner similar to a pivoting movement, the valve flap can be moved along the guide track. In this embodiment, it is possible in a simple manner to move the valve flap into the edge region of the connection channel, thus considerably reducing the flow resistance. Further, in case of a corresponding configuration of the guide elements, the valve flap, e.g. when opened only partially, can serve as a guide plate for the medium flowing through the connection channel.

Said guide elements, such as e.g. guide pins or guide tracks, are preferably arranged in the edge region, particularly in the lateral edge region, of the valve flap so that the medium flowing through the passage opening will be influenced as little as possible and the guide elements will thus offer only a small flow resistance.

Further, in all of the above described embodiments, a plurality of valves can be arranged across the width of the pump housing. This has the advantage that a given valve can be used in several types of pumps, wherein the number of valves is higher in larger pumps than in smaller pumps.

The above described inventions are of advantage especially in rotary-piston pumps. By the provision of corresponding valves, the maximal pressure difference between the suction side and the pressure side can be limited so that, when a defined maximal pressure is exceeded, this will result in a backflow of the conveyed fluid from the outlet side to the suction side. In rotary-piston pumps with large-volume pumping chambers, the maximal pressure difference is about 50 mbar, and in smaller rotary-piston pumps, it is about 80 mbar. Starting from this correspondingly defined limiting pressure, the valve will be opened. By such rotary-piston pumps, suction capacities from 250 to 1300 $m^3/h$ can be achieved, preferably also in case of a one-stage configuration of the pump.

The invention will be explained in greater detail hereunder by way of preferred embodiments with reference to the accompanying drawings.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

Figure 1:
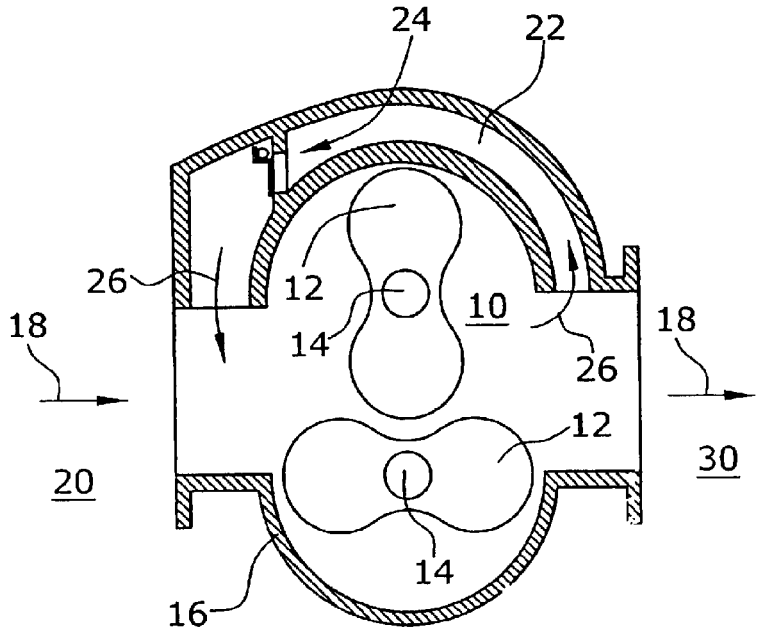
FIG. 1 is a schematic sectional view of a rotary-piston pump.

The rotary-piston pump of the invention comprises two rolling pistons 12 arranged in a pumping chamber 10. Said rolling pistons 12 are arranged for rotation about rotary axes 14 extending perpendicularly to the plane of the drawing. The rolling pistons 12 are arranged in a housing 16. By the action of the rolling pistons 12, the medium will be conveyed in the direction marked by arrow 18 from a suction side 20 toward a pressure side 30.

Particularly for avoidance of overheating, a connection channel 22 is provided in housing 16, said connection channel 22 extending laterally of the pumping chamber 10. Connection channel 22 preferably runs along the entire width—extending vertically to the plane of the drawing—of pump housing 16. Therefore, the connection channel preferably has a rectangular cross section.

Within connection channel 22, a valve 24 is arranged. When a maximal pressure difference between the pressure side 30 and the suction side 20 is exceeded, the spring-loaded valve 24 will open automatically, with the effect that a part of the conveyed fluid will flow back from the pressure side to the suction side 20 in the direction indicated by arrow 26.

Said valve 24, which according to the invention is formed as a flap valve, comprises a valve flap 28 (FIG. 2) closing a rectangular passage opening 32 of connection channel 22. Said passage opening 32 preferably extends across the whole width of connection channel 22 and thus substantially of the whole housing 16. The valve flap 28 is pivotable about a pivot axis 34 in the direction indicated by arrow 36. By means of a torsion spring 40 surrounding said pivot axis 34, a holding and respectively closing force is applied onto valve flap 28. Due to said closing force, valve 14 will open only when a defined pressure difference is reached between the pressure side 30 and the suction side 20 (FIG. 1) of pumping chamber 10.

In the illustrated embodiment, said pivot axis 34 is arranged on the side facing away from pumping chamber 10 so that, for opening the valve flap 28, the valve flap will be pivoted into a corner of the housing. Because of the resultant small constructional space required for the flap valve, pump housing 16 can be given relatively small outer dimensions.

Figure 2:
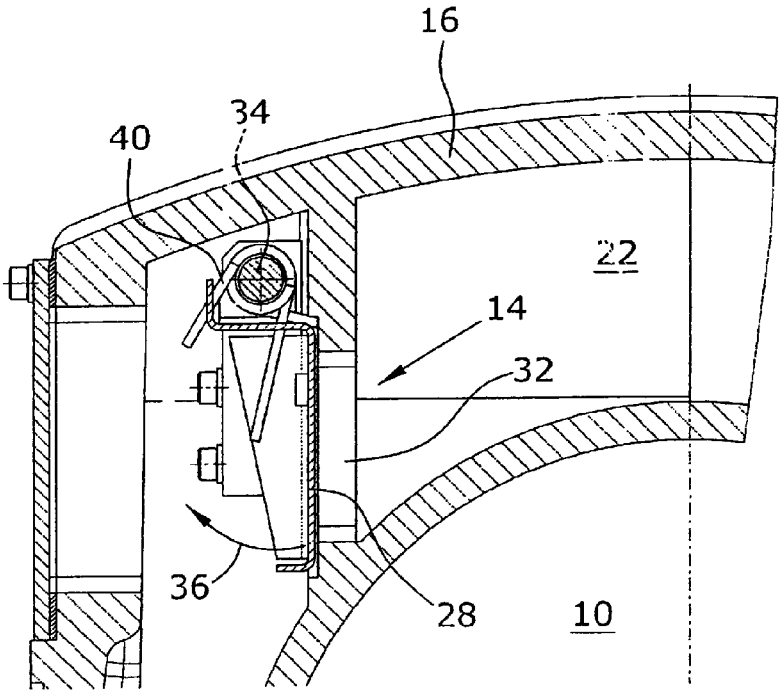
FIG. 2 is an enlarged representation of the flap valve arranged in the connection channel of the rotary-piston pump.
Figure 3:
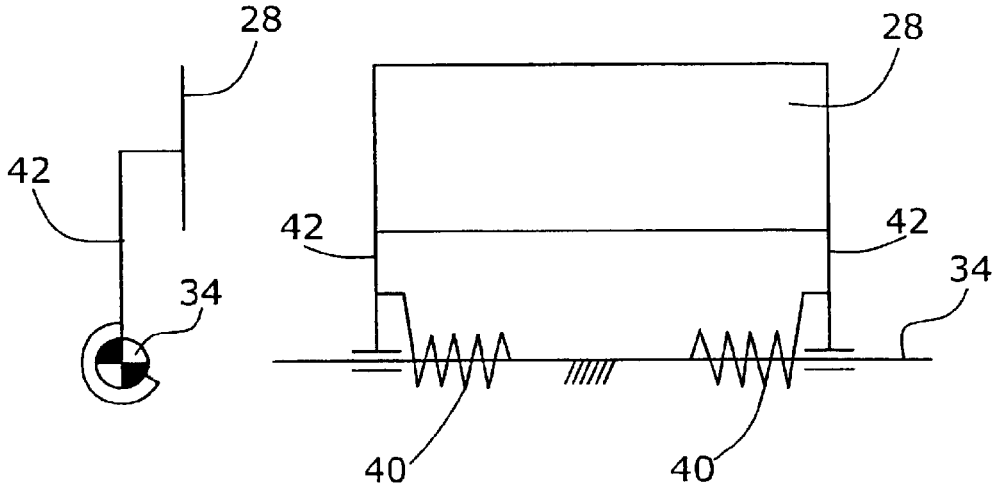
FIG. 3 is a schematic sketch, as seen in lateral view and plan view, of a further embodiment of a flap valve with torsion spring.

From the schematic sketch of FIG. 3, it is evident that valve flap 28 has a rectangular basic shape for closing a likewise rectangular passage opening 32 (FIG. 2). Valve flap 28 can be connected to said pivot axis 34 via pivot arms 42, wherein either said pivot arms are supported on the rigid axis 34 or, in case of a fixed connection of the pivot arms to the pivot axis 34, the pivot axis 34 is supported in a suitable manner. In the principle embodiment of a flap valve according to the invention as shown in FIG. 3, the two pivot arms 42 are each connected to a torsion spring 40 which surrounds the pivot axis 34 and also is fixedly connected thereto.

Figure 4:
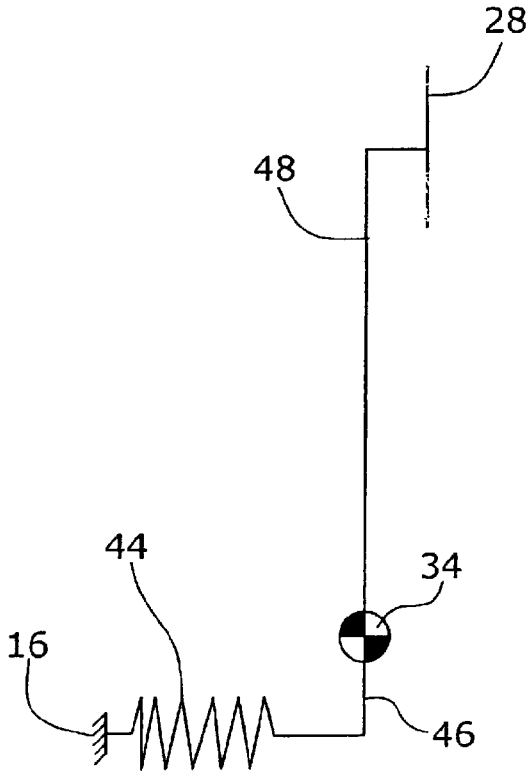
FIG. 4 is a schematic sketch, as seen in lateral view, of a further embodiment of a flap valve with tension spring.

In a further embodiment of the flap valve (FIG. 4), a tension spring 44 is provided instead of said torsion springs. Said tension spring is fixedly connected to the housing 16 and to a pivot arm 46. In the embodiment illustrated in FIG. 4, said pivot arm 46 is arranged, relative to the rotary axis 34, on the side opposite to flap 28. Flap 28 is connected to rotary axis 34 via a connection element 48. Also in the embodiment shown in FIG. 4, the flap is substantially rectangular, which corresponds to the embodiment shown in FIG. 3.

Figure 5:
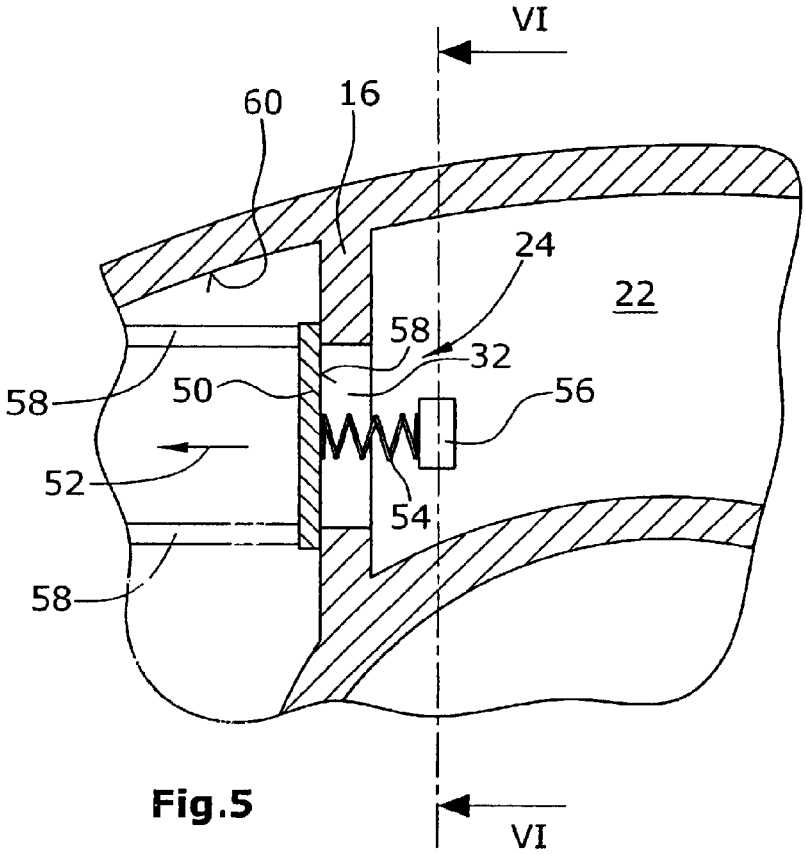
FIG. 5 is a schematic lateral sectional view of a further preferred embodiment of a valve.
Figure 6:
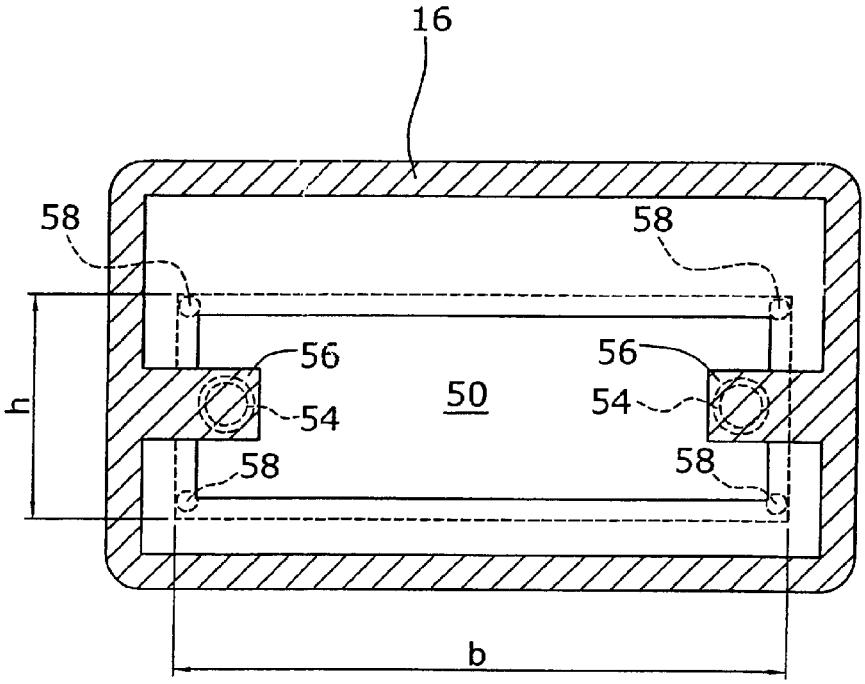
FIG. 6 is a schematic lateral sectional view, taken along the line VI-VI, of the embodiment shown in FIG. 5.

In the embodiment shown in FIGS. 5 and 6, similar or identical components are designated by the same reference numerals.

The essential difference of this embodiment as compared to the embodiment described with reference to FIGS. 1 to 4 resides in that the valve 24 comprises a valve body 50 which, when the maximal pressure difference is exceeded, will not be pivoted but be displaced in the direction marked by arrow 52. For this purpose, said valve body 50 is in both lateral edge regions connected to a respective tension spring 54 wherein, in the illustrated embodiment, said tension springs are attached to a projection 56 of the housing and on an inner side 58 of valve body 50. The valve body has a rectangular cross section whose width b is larger than the height h. Preferably, valve body 50 extends substantially across the whole width of connection channel 22.

To guarantee a safe guidance when the valve body 50 is being opened, i.e. during the movement of the valve body in the direction marked by arrow 52, the illustrated embodiment comprises four guide elements 58 formed as guide pins.

To allow for a movement of valve body 50 similar to the pivoting movement, it is possible, instead of providing said guide pins 58, to provide curved, in particular ring-segment-shaped guide tracks, particularly also in the lateral edge region of valve body 50. Thereby, for instance, one can realize a movement of the valve body 50 along a circular track or the like in the direction towards an inner side 60 of housing 16.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof

The invention claimed is:

1. A vacuum pump, comprising:

pump elements arranged in a pumping chamber defined in a pump housing, a connection channel connecting a pressure side to a suction side of the pumping chamber, a valve arranged in said connection channel and comprising a spring-loaded valve body closing a passage opening, said valve being operative to open when a maximal pressure difference between the pressure side and the suction side has been exceeded, and guide elements connected to the valve body or the pump housing, the guide elements including guide pins or tracks.

2. The vacuum pump according to claim 1, wherein the valve body has a width, extending parallel to the pump housing, that is larger than the height of the valve body.

3. The vacuum pump according to claim 1, wherein the valve is connected to a spring.

4. The vacuum pump according to claim 3, wherein said spring is formed as a tension spring.

5. The vacuum pump according to claim 3, further including:

a setting element for setting a spring force of the spring.

6. The vacuum pump according to claim 3, wherein at least two spring elements are provided.

7. The vacuum pump according to claim 6, wherein said spring elements are arranged in lateral edge regions of the valve body.

8. The vacuum pump according to claim 1, wherein the passage opening is substantially rectangular.

9. The vacuum pump according to claim 1, wherein said guide elements are arranged in lateral edge regions of the valve body.

10. A vacuum pump comprising:

pump elements arranged in a pumping chamber, a connection channel connecting a pressure side to a suction side of the pumping chamber, and a valve arranged in said connection channel and comprising a spring-loaded valve body closing a passage opening, said valve being operative to open when a maximal pressure difference between the pressure side and the suction side has been exceeded, wherein said valve body is formed as a pivotable valve flap, wherein a pivot axis of the valve flap extends parallel to a rotary axis of said pump elements which are formed as roller bodies, and wherein the center of gravity of the valve flap substantially coincides with the pivot axis.

11. The vacuum pump according to claim 10, wherein the passage opening is substantially rectangular.

12. The vacuum pump according to claim 10, wherein the passage opening extends substantially across a whole width of the connection channel.

13. The vacuum pump according to claim 10, wherein the valve is connected to a spring.

14. The vacuum pump according to claim 13, wherein said spring is formed as a torsion spring.

15. The vacuum pump according to claim 13, wherein said spring is connected to a pivot arm.

16. The vacuum pump according to claim 13, further including:

a setting element for setting a spring force of the spring.

17. The vacuum pump according to claim 10, wherein the valve body has a width extending parallel to the pump housing that is larger than a height of the valve body.

18. The vacuum pump according to claim 10, wherein the pivot axis of the valve flap is arranged on a side of the connection channel facing away from the pumping chamber.

19. A vacuum pump comprising:

pump elements arranged in a pumping chamber, a connection channel connecting a pressure side to a suction side of the pumping chamber, a valve arranged in said connection channel and comprising a spring-loaded valve body closing a passage opening, said valve being operative to open when a maximal pressure difference between the pressure side and the suction side has been exceeded, wherein the valve body has a width, extending parallel to the pump housing, that is larger than the height of the valve body, and guide elements in the form of guide pins or guide tracks, which are connected to the valve body or the pump housing, said guide elements being arranged in the lateral edge regions of the valve body.

* * * * *